US006113244A

United States Patent [19]

Baumgartner

[11] Patent Number: 6,113,244

[45] Date of Patent: Sep. 5, 2000

[54] FIBER OPTIC LIGHTED HELMET

[76] Inventor: Michael P. Baumgartner, 10817 Sam Snead, El Paso, Tex. 79935

[21] Appl. No.: 09/083,916

[22] Filed: May 26, 1998

Related U.S. Application Data

[60] Provisional application No. 60/047,831, May 28, 1997.

[51] Int. Cl.[7] ..... F21L 15/14

[52] U.S. Cl. ..... 362/106; 362/105

[58] Field of Search ..... 362/105, 106, 362/570, 263, 555

[56] References Cited

U.S. PATENT DOCUMENTS

| | | |
|---|---|---|
| 4,186,429 | 1/1980 | Johnston . |
| 4,231,079 | 10/1980 | Heminover . |
| 4,761,720 | 8/1988 | Solow . |
| 4,891,736 | 1/1990 | Gouda . |
| 4,998,186 | 3/1991 | Cocca . |
| 5,327,588 | 7/1994 | Garneau . |
| 5,357,409 | 10/1994 | Glatt . |
| 5,416,675 | 5/1995 | DeBeaux . |
| 5,508,900 | 4/1996 | Norman . |
| 5,544,027 | 8/1996 | Orsano . |
| 5,559,680 | 9/1996 | Tabanera . |
| 5,588,736 | 12/1996 | Shea, Sr. ..... 362/106 |
| 5,758,947 | 6/1998 | Glatt ..... 362/106 |

FOREIGN PATENT DOCUMENTS

| | | |
|---|---|---|
| 215501 | 1/1990 | Japan . |
| WO 93/22160 | 11/1993 | WIPO . |

*Primary Examiner*—Nimeshkumar D. Patel
*Assistant Examiner*—Todd Reed Hopper
*Attorney, Agent, or Firm*—Richard C. Litman

[57] ABSTRACT

A safety helmet for use during potentially dangerous activities, such as bicycling or rollerblading. The helmet is a two piece helmet having a hard outer shell and a high density polystyrene inner shell. An illuminating assembly is recessed within the exterior portion of the inner shell. The illuminating assembly has a power source connected to a multitude of light sources, which are preferably light emitting diodes (LEDs). The LEDs are connected to a multitude of fiber optic cables via a cylindrical connector. Light from the LEDs shine into an end of the fiber optic cable. This light emits out of the cladding of the fiber optic cable if the cable is a side light fiber optic cable. The light emits out of the other end of the cable if the cable is a point-to-point fiber optic cable. The outer shell has a transparent portion corresponding to the pathway taken by the illuminating assembly so that light can emit past the outer shell.

5 Claims, 4 Drawing Sheets

FIBER OPTIC LIGHTED HELMET

CROSS-REFERENCE TO RELATED APPLICATION

This application claims the benefit of U.S. Provisional Patent: Application Ser. No. 60/047,831, filed May 28, 1997.

BACKGROUND OF THE INVENTION

1. Field of the Invention

The present invention relates generally to an illuminated safety helmet and, more particularly, to a helmet illuminated by fiber optic cables.

2. Description of Related Art

In our active society, people engage in physical activities which have a high potential for head injury. Such activities include bicycling or rollerblading. Frequently, people wear helmets while engaging in such activities as a protective measure. A typical helmet, e.g. one that is not illuminated, serves its purpose in protecting the user's head during daytime use. However, there are times where a person needs protection during dusk or evening hours. Thus, various illuminated safety helmets are known in order to visually alert others of the presence of the user.

The types of illuminated helmets generally fall into one of two categories. The first include those helmets where the illuminating means is flush with the helmet. This arrangement accomplishes the goal of visually warning others of the users presence, while not impeding with the aerodynamic performance of the helmet.

For example, U.S. Pat. No. 5,559,680, issued Sep. 24, 1996 to Dennis A. Tabanera shows a two piece helmet in which an electroluminescent lamp film is located between the inside and outside layer. The film disclosed is a transparent insulator with embedded phosphorous. The problem with this arrangement is that: finding a replacement for the phosphorous film would be difficult: in the event of a defect in the phosphorous film.

Although not discussed in the above invention, the '680 invention could use the illuminated tape disclosed in U.S. Pat. No. 4,761,720, issued Aug. 2, 1988 to Joseph E. Solow. This tape has a plurality of light emitting diodes ("LEDs") embedded in the tape. However, the same problems as discussed above would exist by using this type of tape.

Another helmet with the illuminating means flush with the helmet is shown in U.S. Pat. No. 5,357,409, issued Oct. 18, 1994 to Terry L. Glatt. The '409 patent shows a helmet with a plurality of LEDs disposed around the helmet, which are powered by a removable power source recessed in the top of the helmet. The housing containing the power source also has control circuitry for sequentially illuminating the LEDs, thus giving the appearance of moving lights upon the helmet. A problem with this invention is that the large housing for the power source and control circuitry requires a large cavity in the top of the helmet in order for the housing to be flush with the helmet. The large cavity in the helmet weakens the structural integrity of the helmet, thereby lessening its effectiveness in protecting the user from an impact to the head. Also, the complexity of the wiring and circuitry causes difficulty for the user in troubleshooting. This difficultly may discourage the user from fixing the problem, thus rendering the illuminative protection from the helmet useless.

Other helmets with flush illuminative means are seen in U.S. Pat. No. 4,891,736, issued Jan. 2, 1990 to Adam Gouda (Signal Helmet); U.S. Pat. No. 5,327,588, issued Jul. 12, 1994 to Louis Garneau (Safety Helmet for Cyclists); and U.S. Pat. No. 5,416,675, issued May 16, 1995 to Robert J. DeBeaux (Illuminated Helmet).

The second type of illuminative helmets include those helmets where the illuminating means is located on the outside of the helmet. For example, U.S. Pat. No. 4,186,429 issued Jan. 29, 1980 to Walter A. Johnston discloses a helmet which has a flashing light attached to the top of a helmet. While effective in visually alerting others of the presence of the cyclist, this invention hinders the aerodynamic performance of the helmet. The invention also poses a danger to the cyclist or bystanders in the event that the light dislodges in an accident.

Other helmets with external illuminating means are shown in U.S. Pat. No. 4,231,079, issued Oct. 28, 1980 to Stephen R. Heminover (Article of Wearing Apparel); U.S. Pat. No. 5,508,900, issued Apr. 16, 1996 to Charles H. Norman (Illuminated Bicycle Helmet); and U.S. Pat. No. 5,544,027, issued Aug. 6, 1996 to Anthony Orsano (LED Display for Protective Helmet and Helmet Containing Same).

In prior art not related to safety helmets, there are publications which describe headgear with illumination. For example, U.S. Pat. No. 4,998,186 issued Mar. 5, 1991 to Lorraine Cocca shows a decorative hair ornament with a plurality of fiber optic cables. The fiber optic cables are attached to a LED light source. However, the purpose for this invention is purely for fashion's sake and not to serve as a warning device.

None of the above inventions and patents disclose a helmet with a flush illuminating means, where the illuminating means is; comprised of a plurality of fiber optic cables. None of the above inventions and patents, taken either singly or in combination, is seen to describe the instant invention as claimed.

SUMMARY OF THE INVENTION

The present invention regards an apparatus for protecting a person's head while illuminating the apparatus in order to alert others of the wearer's presence, especially at night. The apparatus comprises an outer shell with an opaque area and a transparent area, and an inner shell corresponding to the shape of the hard outer shell. Both the outer shell and inner shell have an exterior surface and an interior surface. The two shells matingly interface at the interior surface of the outer shell and the exterior surface of the inner shell.

Recessed into the exterior surface of the inner shell is an illuminative assembly. The illuminative assembly comprises a power source, a plurality of lights sources electrically connected to the power source, a plurality of cylindrical connectors with one end attached to a light source, and a plurality of fiber optic cables which are attached to the other end of the cylindrical connectors.

Light from the light source shines into an end of a fiber optic cable. Light entering into the fiber optic cable either emits out of the opposite end of the cable, or through the sides, known as cladding, of the cable. Whether light emits from the cladding depends on the type of fiber optic cable used. In a point-to-point fiber optic cable, light enters one end of the cable and emits out of the opposite end, with no loss of intensity. No light emits out of the cladding due to a phenomena known as "total internal reflection." Light entering into one end of a point-to-point fiber optic cable bounces around within the cable until it exits out of the opposite end of the cable. Conversely, a side light fiber optic cable allows light to emit out of the cladding.

The transparent area of the outer shell generally corresponds to the pathway defined by the recessed area in which the fiber optic cables lie. This allows the light illuminating from the fiber optic cables to emit out of the outer shell. Therefore, when a person uses the fiber optic lighted helmet at nighttime, others are visually warned of the person's presence. This visual warning allows the other person to take the necessary precautions against: colliding with the person wearing the helmet.

Accordingly, it is a principal object of the invention to provide a user of the helmet protection against head injury.

It is another object of the invention to provide a user of the helmet visual protective warning of the users presence to others, especially when the helmet is in use at nighttime.

It is a further object of the invention to provide lightweight protection which encourages the user to actually use the helmet during potentially dangerous activities such as bicycling or rollerblading.

It is another object of the invention to provide illuminative protection that is easy to repair.

Still another object of the invention is to provide protection which does not hinder aerodynamic performance.

It is an object of the invention to provide improved elements and arrangements thereof in an apparatus for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
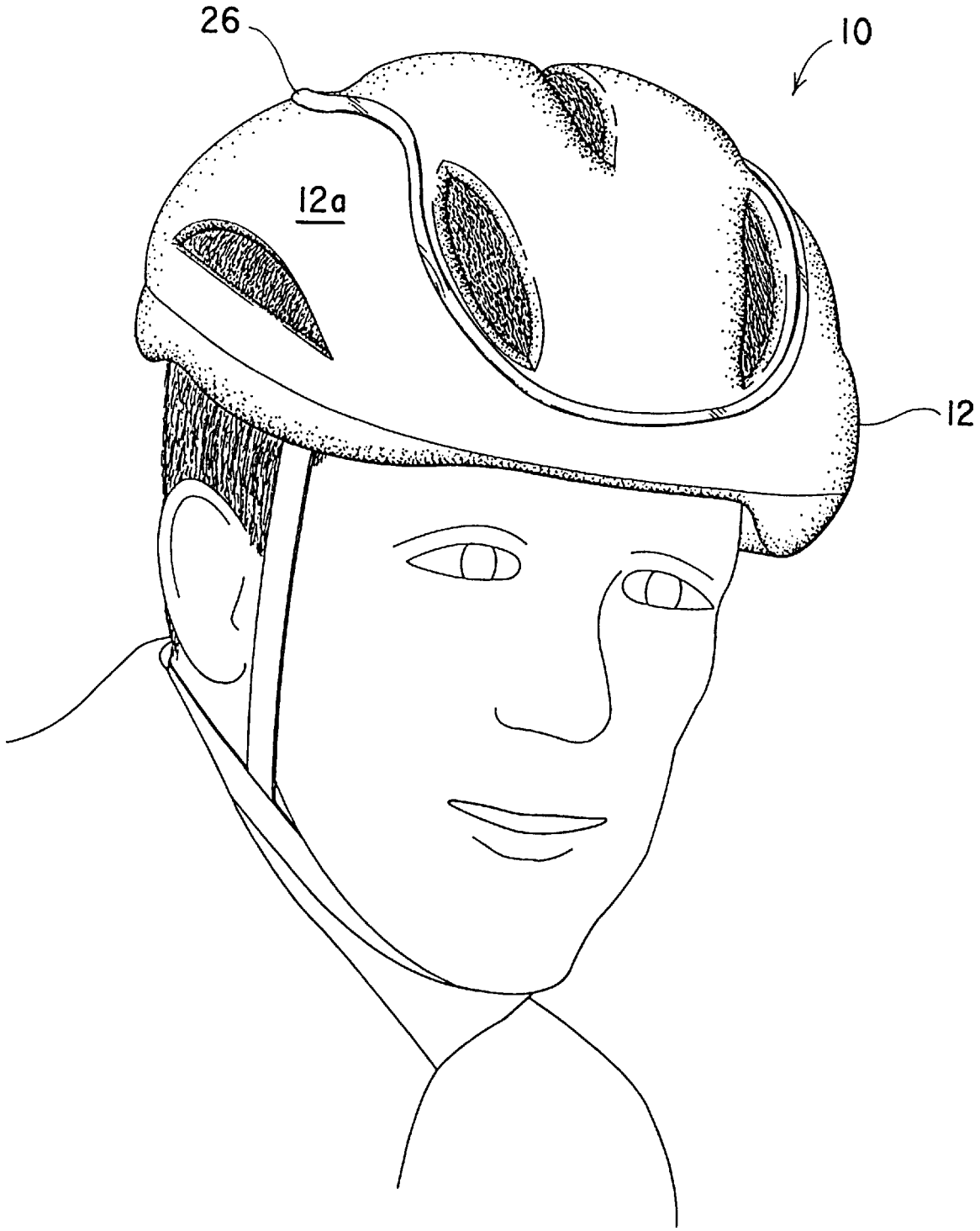
FIG. 1 is an environmental front view of the fiber optic lighted helmet in use.

The present invention relates to an illuminated safety helmet. The preferred embodiment of the fiber optic lighted helmet 10, shown in FIGS. 1 and 2, serves to protect the user against head injury by absorbing an impact to the head and diffusing the impact about the helmet 10. The helmet 10 is lighted in order to provide others visual warning of the users presence, especially at nighttime.

For impact protection, the helmet 10 comprises an outer shell 12 preferably made of hard impact resistant material. The outer shell 12 has an exterior surface 12*a* and an interior surface (not shown). The helmet 10 also has an exterior surface 14*a* and an interior surface (not shown). The inner shell 14 is preferably made of high density polystyrene foam. The inner shell 14 generally conforms to the shape of the outer shell 12, wherein the two shells 12,14 are matingly connected to one another, with the exterior surface of the inner shell 14*a* nesting with the interior surface of the outer shell (not shown). In the preferred embodiment, the helmet 10 has a plurality of air holes 28 which allows passage of air to cool the user when using the helmet 10.

To illuminate the preferred embodiment, the helmet 10 has an illuminative assembly 15 which provides 360° illumination. This visually warns others in all directions of the user's presence. The illuminative assembly 15 lies within a recessed channel 30 in the inner shell 14. The outer shell 12 has a transparent area 26 corresponding to the path of the illuminative assembly 15 so as to allow light to emit past the outer shell 12.

Figure 2:
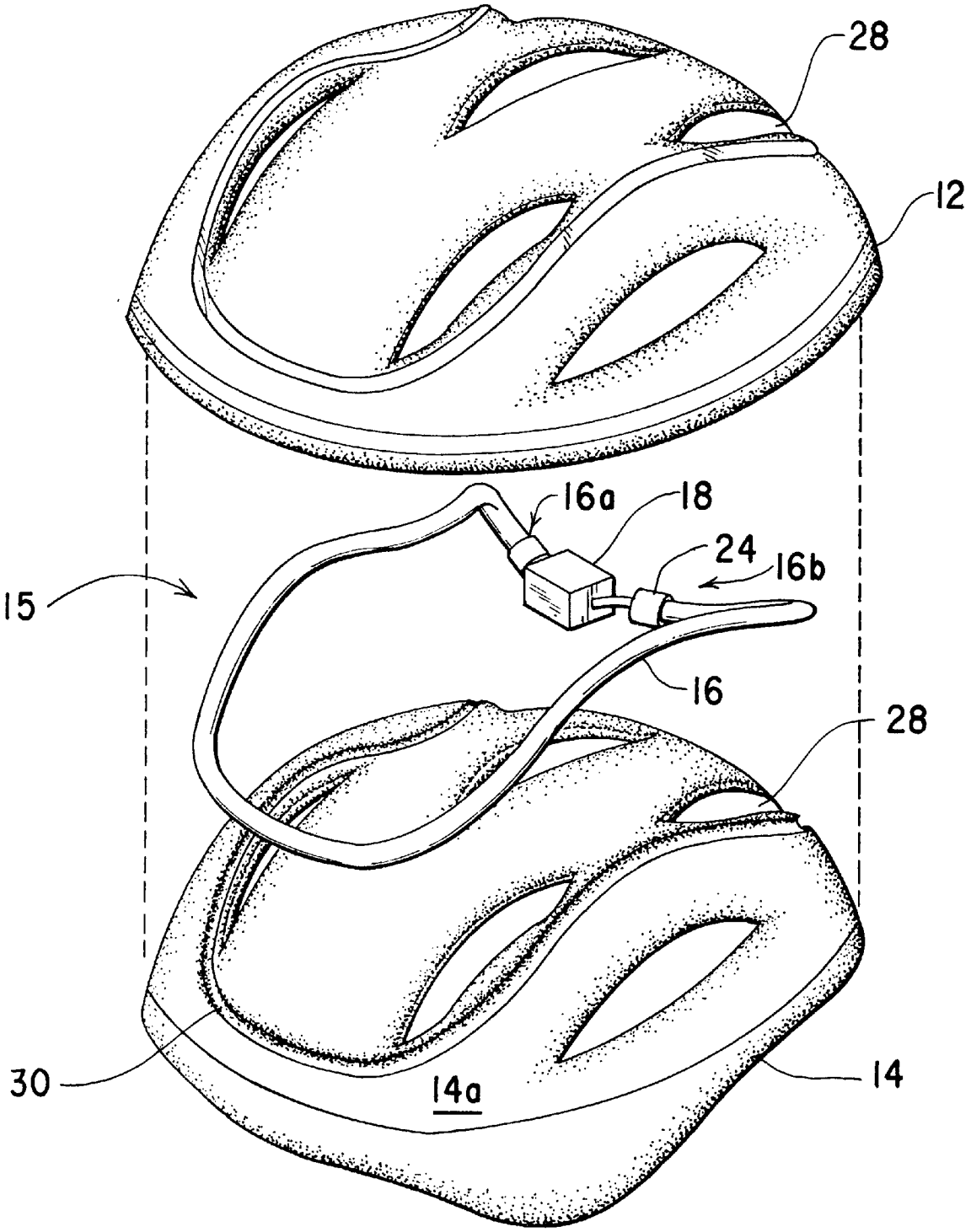
FIG. 2 is an exploded perspective view of the fiber optic lighted helmet.
Figure 4:
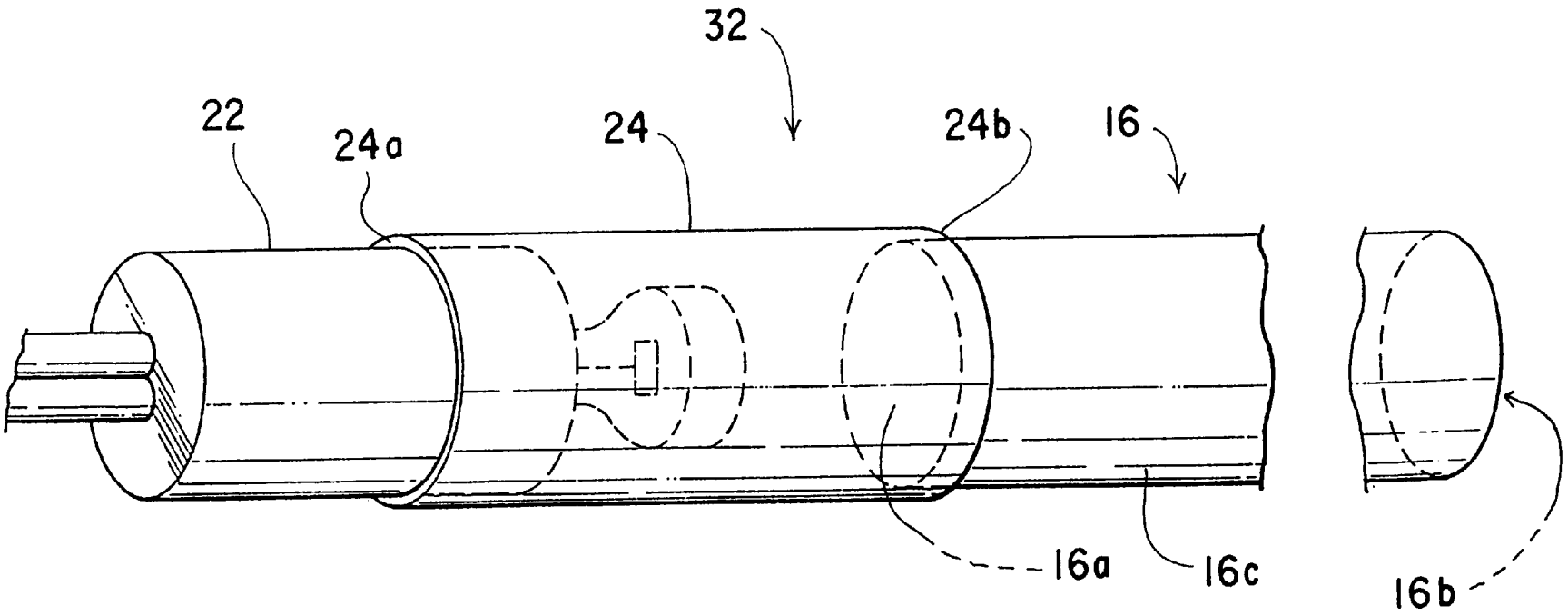
FIG. 4 is a perspective side view of the LED light source and fiber optic cable connection via the cylindrical connector.

Momentarily referring to FIGS. 2 and 4 together, the illuminative assembly 15 comprises a power source 18, a fiber optic cable 16, and a plurality of connectors 24 each housing a light source 22 (shown in FIG. 4). The fiber optic cable 16 has two ends 16*a*, 16*b* from which light can enter and exit, and a cladding 16*c* along its length, selected either for light emission or total internal reflection. The different types of fiber optic cables 16 used in the helmet 10 are more fully discussed below.

In the preferred embodiment of the invention, the power source 18 is a nine volt battery; however, any battery or alternate form of power can be substituted for the nine volt battery. The power source 18 is in electrical communication with the light sources 22 via a wire 20. The light sources 22 are preferably Light Emitting Diodes (LEDs). A switch, not shown in the drawings, may be interposed between the power source 18 and light sources 22 in order to activate or inactivate the light sources 22. Alternatively, a standard 9V battery connector (not shown) may be provided to snap onto and off the positive and negative terminals of the 9V battery.

FIG. 4 shows the light source/fiber optic assembly 32, a portion of the illuminative assembly 15. This assembly 32 facilitates the shining of the light from the light source 22 into an end of the fiber optic cable 16*a*. Fiber optic cable 16 may either by a unitary fiber light conductor or a plurality of fiber light conductors 17*a*, 17*b*, 17*c* (shown in dotted lines in FIG. 3). For either a single cable or plurality of cables, the connector 24 keeps the light source 22 and the fiber optic cable 16 in fixed close proximity to each other. The connector 16 is generally cylindrical in shape, having two ends 24*a* and 24*b*. One end of the connector 24*a* snugly fits over the light source 22, and the other end of the connector 24*b* fits snugly over one end of the fiber optic cable 16*a*. The opposing end 16*b* is similarly facilitated with another light source/fiber optic assembly 32.

The helmet 10 may use two types of fiber optic cables 16. In the first type of fiber optic cable 16, light does not escape from the cladding 16*c*. This is known as a point-to-point fiber optic cable. Light enters into one end of a point-to-point fiber optic cable 16*a* and emits out of the other end 16*b* with equal intensity. No light emits out of the cladding 16*c* of a point-to-point fiber optic cable. Light reflects within the point-to-point fiber optic cable 16 in a phenomena known as "total internal reflection."

The other type of fiber optic cable 16 is known as a side light fiber optic cable. Unlike the point-to-point type, the side light cable emits light from the cladding 16*c*. The side light cable is the type of cable that provides the invention's 360° illumination, as used in the preferred embodiment as shown in the Figures showing the illuminative assembly 15. In such side light fiber optic cable, both ends of the cable 16*a*, 16*b* are part of a separate light source/fiber optic assembly 32. This arrangement insures that the fiber optic cable 16 illuminates with substantially equal intensity throughout the cladding 16*c*.

Figure 3:
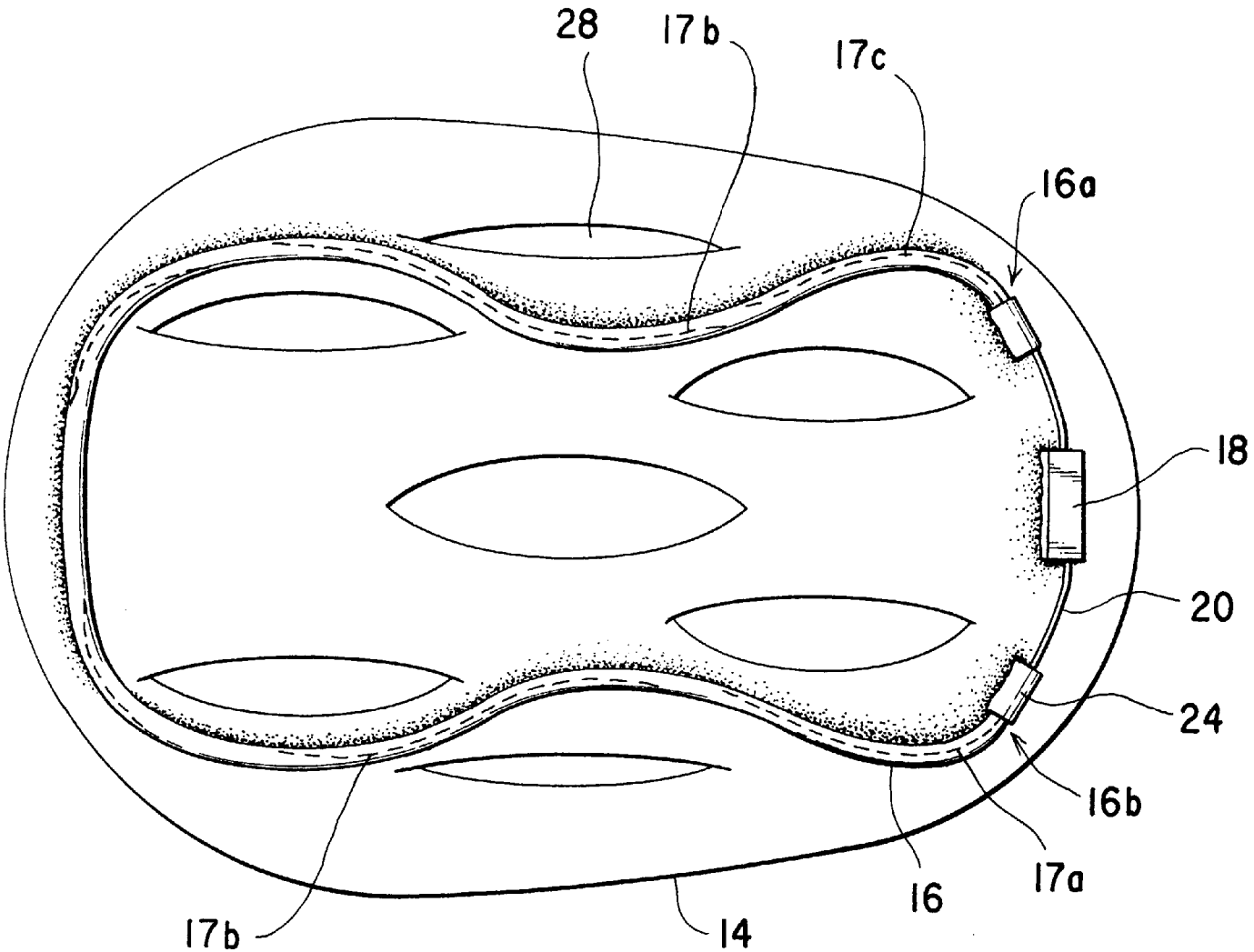
FIG. 3 is a plan view of the inner shell and the illuminative assembly.

However, another embodiment, not shown in the drawings, is described wherein the fiber optic cables 16 are a mixture of point-to-point and side light cables. As in the above embodiment, both ends of the side light cable 16*a*, 16*b* are preferably part of a separate light source/fiber optic assembly 32. However, one end of the side light 16*a* or 16*b* could be free of a light source/fiber optic assembly 32. In this embodiment, the point-to-point cables have only one end 16*a* attached to an assembly 32. The plurality of point-to-point cables are of arbitrarily different lengths so as to give the appearance of a multitude of single points of lights. As seen in FIG. 3, a plurality of fiber light conductors 17*a*, 17*b*, 17*c*, shown in dotted lines, illustrate the plurality of point to point cables, and/or the plurality of side light and point to point cables.

It is to be understood that the present invention is not limited to the embodiments described above, but encompasses any and all embodiments within the scope of the following claims.

I claim:

1. A safety helmet comprising:

an outer shell having a transparent area and an opaque area, and a first exterior surface and a first interior surface;

an inner shell with a second exterior surface and a second interior surface, said second exterior surface matingly attached to said first interior surface of said outer shell;

a power source disposed within a recess formed in said inner shell at said second exterior surface;

a plurality of light sources electrically connected to said power source and recessed in said inner shell at said second exterior surface;

a plurality of connectors having one end attached to said light sources and recessed in said inner shell at said second exterior surface, and an opposite end; and at least one fiber optic cable having two ends and a cladding, said at least one fiber optic cable being attached to the opposite end of said connectors and recessed into said inner shell at said second exterior surface corresponding to the transparent areas of said outer shell.

2. A safety helmet according to claim 1, wherein said power source is a battery.

3. A safety helmet according to claim 2, further comprising a power switch for controlling the flow of electrical power from said power source to said light source.

4. A safety helmet as set forth in claim 1, wherein said at least one fiber optic cable allows light to emit from said cladding.

5. A safety helmet as set forth in claim 1, wherein said at least one fiber optic cable include a plurality of side light fiber optic cables and point-to-point fiber optic cables of arbitrarily different lengths.

* * * * *